US009752765B2

(12) United States Patent
Rashidi Doust

(10) Patent No.: US 9,752,765 B2
(45) **Date of Patent: *Sep. 5, 2017**

(54) FIRE RATED RECESSED LIGHTING ASSEMBLY

(71) Applicant: ELITE LIGHTING, Commerce, CA (US)

(72) Inventor: Hamid Rashidi Doust, Beverly Hills, CA (US)

(73) Assignee: Elite Lighting, Commerce, CA (US)

( * ) Notice: Subject to any disclaimer, the term of this patent is extended or adjusted under 35 U.S.C. 154(b) by 228 days.

This patent is subject to a terminal disclaimer.

(21) Appl. No.: 14/677,979

(22) Filed: Apr. 3, 2015

(65) Prior Publication Data

US 2016/0238225 A1 Aug. 18, 2016

Related U.S. Application Data

(60) Provisional application No. 62/116,871, filed on Feb. 16, 2015.

(51) Int. Cl.
*F21V 25/12* (2006.01)
*F21V 25/02* (2006.01)
(Continued)

(52) U.S. Cl.
CPC ..... *F21V 25/125* (2013.01); *F21S 8/026* (2013.01); *F21V 25/02* (2013.01); *F21V 29/83* (2015.01)

(58) Field of Classification Search
CPC ..... F21V 25/125; F21V 25/00; F21V 25/10
See application file for complete search history.

(56) References Cited

U.S. PATENT DOCUMENTS 6,105,334 A * 8/2000 Monson ..... F21S 8/02 52/232
6,226,939 B1 * 5/2001 Atkins ..... F21S 8/02 52/232

(Continued)

FOREIGN PATENT DOCUMENTS

EP 2484968 8/2012
GB 2270936 3/1994

(Continued)

OTHER PUBLICATIONS

U.S. Appl. No. 14/555,029, filed Nov. 00, 2014, entitled "Downlight Firestop."

*Primary Examiner* — Andrew Coughlin
*Assistant Examiner* — Christopher E Dunay
(74) *Attorney, Agent, or Firm* — Payam Moradian

(57) ABSTRACT

Provided is a fire rated or resistant recessed lighting assembly including a metal housing inside of which a lighting unit is placed, the housing being fire resistant for 120 minutes when tested according ASTM E119-12a without a protective fire resistant cover on outside of the housing. The fire resistant recessed lighting assembly can include a metal housing inside of which a light is placed and one or both of: i) an object made of a fire resistant material, such as an intumescent material, placed inside of the housing in between a trim and a closed end of the housing; and ii) an ring made of a fire resistant material, such as an intumescent material, placed outside of the housing, wherein in event of a fire, the intumescent material expands to slow spread of the fire.

12 Claims, 9 Drawing Sheets

(51) Int. Cl.
*F21V 29/83* (2015.01)
*F21S 8/02* (2006.01)

(56) References Cited

U.S. PATENT DOCUMENTS

| | | | | |
|---|---|---|---|---|
| 7,320,536 | B2 | 1/2008 | Petrakis | |
| 7,670,033 | B2 | 3/2010 | Steer | |
| 2008/0165545 | A1* | 7/2008 | O'Brien | F21S 8/02 362/364 |
| 2008/0170404 | A1* | 7/2008 | Steer | F21S 8/02 362/365 |
| 2016/0146446 | A1* | 5/2016 | Luo | F21V 25/125 362/365 |

FOREIGN PATENT DOCUMENTS

| | | |
|---|---|---|
| GB | 2415245 | 12/2005 |
| GB | 254449 | 5/2009 |

* cited by examiner

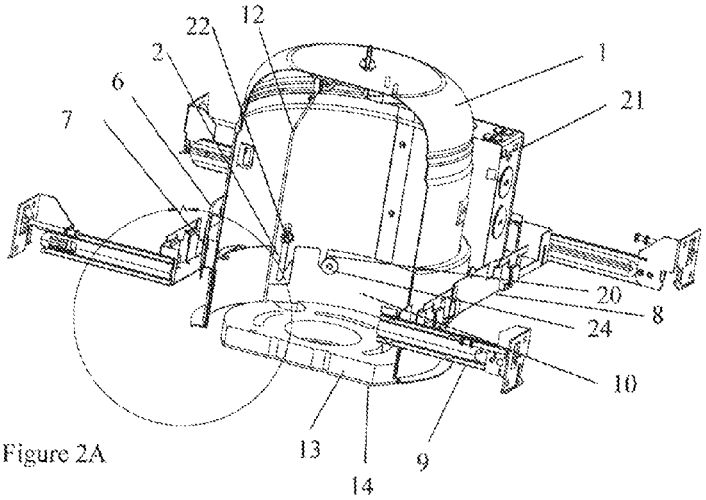
Figure 2A
Figure 2B
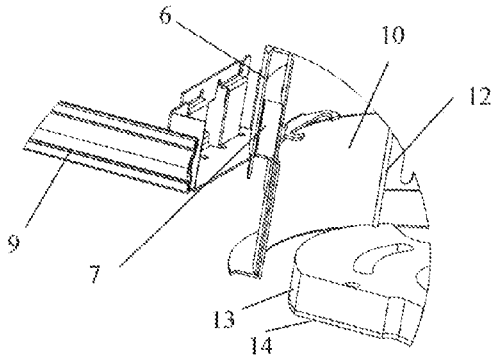

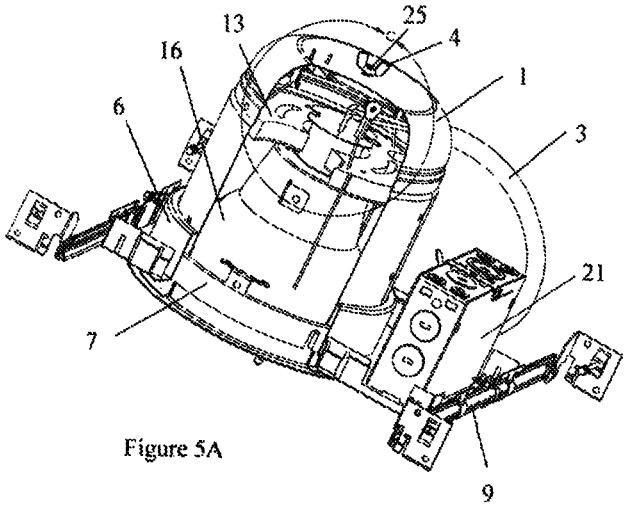
Figure 5A
Figure 5B
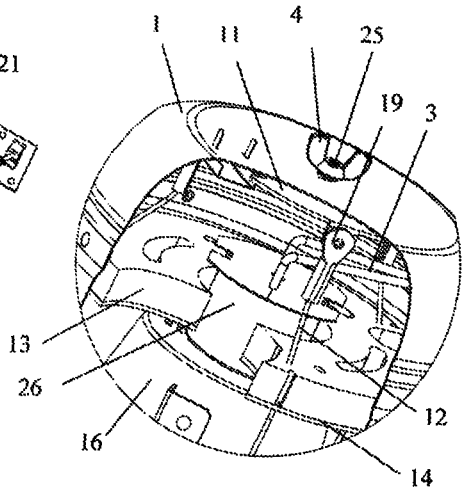

FIRE RATED RECESSED LIGHTING ASSEMBLY

CROSS-REFERENCE

The present application claims the benefit of provisional application No. 62/116,871, filed on Feb. 16, 2015, which is incorporated herein by reference in its entirety.

BACKGROUND SECTION OF THE INVENTION

Recessed luminaries are placed in the and there is a need that they contain a fire for between 60 to 120 minutes, otherwise a fire from one lighting assembly in a ceiling can spread to a floor above the ceiling where the lighting assembly is placed.

To address the issue of fire rated lighting assembly, generally an enclosure is built around a recessed light. These enclosures include a fire box that surrounds the recessed light. The problem with fire boxes is that multiple subcontractors may be needed to install a recessed light. The fire boxes may not be designed for standard 2×8 joist construction, requiring larger joist that may be more expensive to construct. Due to the size of the box, recessed lights cannot be installed in close proximity to each other or close to the wall. The fire box can only be installed along a long axis. Furthermore, requiring installing the fire box first and then installing the recessed light inside the box can cause delays in construction and increases the overall cost of labor and material. The use of a fire box may use additional materials such as drywall, caulk, gaskets, hats and joint tape. Lastly, because a box must be made from drywall around each recessed light, additional clearance is needed, thereby limiting location.

There is a need in the art for a fire rated recessed lighting assembly that addresses the above problems.

SUMMARY SECTION OF THE INVENTION

Provided is a the resistant or rated recessed lighting assembly comprising a metal housing inside of which a light is placed, the housing being fire resistant for 120 minutes when tested according ASTM E119-12a without a protective fire resistant cover on outside of the housing. A fire resistant material, such as an intumescent material, can be placed inside and/or outside of the housing.

Provided is a fire rated or resistant recessed lighting assembly comprising: a) a metal housing inside of which a light is placed, the metal housing having an open and a closed end; b) a trim; and c) an object made of a fire resistant material, such as an intumescent material placed inside of the housing in between the closed end of the housing and the trim; wherein in event of a fire, the fire resistant material slows spread of fire. If the fire resistant material is an intumescent material, then the intumescent material expands to slow spread of the fire. The object can span the diameter of the housing just short of touching the housing. The trim can be a decorative trim that may or may not also act as a reflector. The trim can be a support trim, which may have a tubular section that fits inside of the housing, and a flange that extends in annular relationship outside of the opening of the housing. The light assembly can further comprise wires attached to top of the housing, to which wires the intumescent object is slidably or movably attached, wherein in event of a fire, the decorative trim melts and the intumescent material slides or moves down the wires. The light assembly can further comprise stoppers attached to an end of the wires for stopping the intumescent object from further sliding down. The light assembly can further comprise a bracket for attaching the wires to the top of the housing. The intumescent object can be a disc made of an intumescent material. The intumescent disc can have a central opening. A socket in electronic communication with an electric cable from a junction box on outside of the housing can be placed inside of the housing, with a least a portion of the socket or the electric cable passing through the central opening of the disc inside of the housing. Heat vents can be present on the intumescent disc. An intumescent ring can be placed outside of the housing to cover one or more openings for attaching the housing to a structure outside of the housing. The disc can be slidably attached to the closed end of the housing with wires. One or more metal wires can be attached to the closed end of the housing, the intumescent disc slidably attached to the wires. A support can be attached to the open end of the housing. A cover can be used for covering the intumescent ring to sandwich the intumescent ring in between the cover and the housing. A metal support below the intumescent disc can be used, the metal disc having openings through which the wires pass to allow the metal support and the intumescent disc slide. One or more stoppers attached at a second end of the wire can be used to stop the metal support front falling out when the metal support reaches the second end of the wire. A metal frame for attaching the housing through a connection with the slot of the housing can be used. A cover can be used for covering the intumescent ring to sandwich the intumescent ring in between the cover and the housing.

Provided is a fire rated or resistant recessed lighting assembly comprising: a) a metal housing inside of which a light is placed; and b) a ring made of an intumescent material placed outside of the housing; wherein in event of a fire, the intumescent material expands to slow spread of the fire. Channels, such as U-Shaped channels, can be present on the intumescent ring, which can complement slots on the housing for adjusting the housing relative to a frame. A cover that surrounds the ring on outside to sandwich the ring in between the housing and the cover can be used. The cover can be made of aluminum and designed to crumple, melt and/or break when the intumescent ring expands.

BRIEF DESCRIPTION OF THE DRAWINGS

FIG. 2A is view illustrating a cutaway portion of the inside of the housing.

FIG. 2B is a close-up of the view illustrated in FIG. 2A.

FIG. 5A is view illustrating a cutaway portion of the inside of the housing.

FIG. 5B is a close-up of the view illustrated in FIG. 5A.

DETAILED DESCRIPTION SECTION OF THE INVENTION

Provided is a fire rated recessed lighting assembly that can contain a fire for at least 60 or 120 hours without the need of a fire box around the recessed lighting assembly. The elimination of the fire box or other fire deterrent construction reduces the cost of installation and allows for the flexibility of arranging the lighting assembly in more locations and closer arrangements. The fire rated recessed lighting assembly is adapted to be disposed in relation to an opening defined in a surface of a structure (i.e. a hole or trough cut into a wall or suspended ceiling) such that a socket (with a lamp or LED strips) can be installed in the light assembly fixture through the opening.

Figure 1:
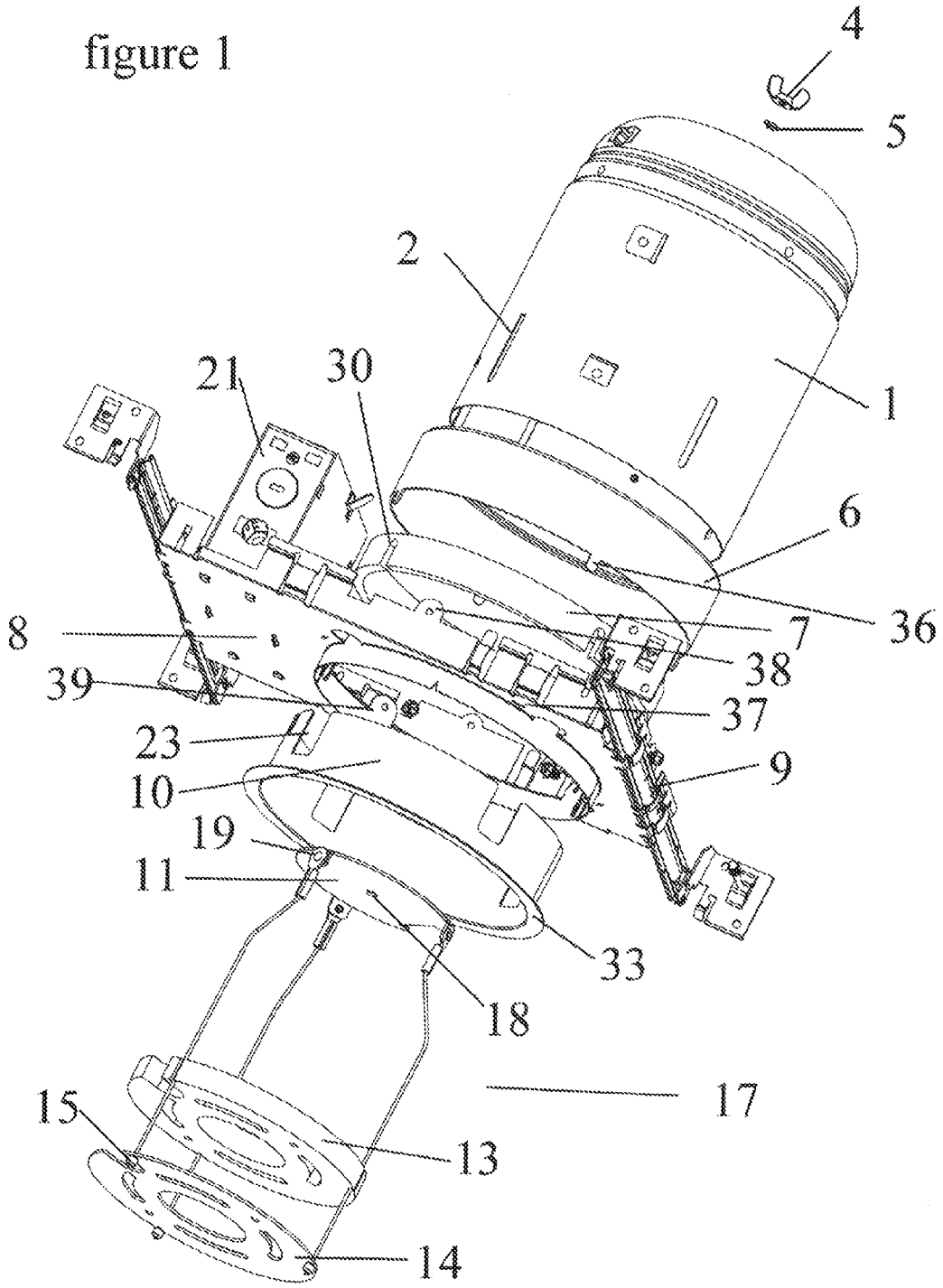
FIG. 1 is an exploded view of the fire rated recessed lighting assembly.

FIG. 1 is an exploded view of the fire rated recessed lighting assembly. The recessed lighting assembly has a housing 1. The housing can be in the shape of a can, with a tubular body with an open end and a closed end. The open end at the bottom of the can is an aperture that generally faces downward. The housing 1 can have a dome shape. The housing 1 can have a slot 2 that allows for adjusting the location of the recessed light in relation to the ceiling. An intumescent ring 7 is fitted over the housing 1. The intumescent ring 7 is placed in proximity of the side openings of the housing 1 which are closer to the open end of the housing 1. These side openings of the housing are slots 2, which allow adjusting position of housing 1 in relation to frame 8. Also shown in FIG. 1 is a cover 6 for the intumescent ring 7. The cover 6 is placed over the intumescent ring 7. Cover 6 is attached to frame 8 through tabs 36. Tabs 36 complement slots 37 on the frame and secure cover 6 to the frame. The intumescent ring is sandwiched by the housing 1 on the inside and cover 6 on the outside. The lighting assembly can further include a support trim 10. Support trim 10 is placed attached to the housing 1 in proximity to the opening of the housing and extends out of the opening of the housing, and generally contacts the drywall. Support trim 10 can further include a flange 33. Flange 33 can cover the exposed edges of the drywall in the opening of the structure (e.g. ceiling) into which housing 1 is placed. The support trim 10 can further include a cut portion 23 on its tubular portion. Cut portion 23 complements slot 2 of housing 1. Support trim 10 can be attached to the housing 1 through groove 20 (illustrated in FIG. 2A) on the tubular portion of support trim 10. The diameter of support trim 10 is such so that it can be placed inside of the housing 1, and rotated so that a complementary screw on the inside of the housing 1 holds support trim 10 in place through groove 20.

Sub-assembly 17 is placed inside of the housing 1. Sub-assembly 17 includes bracket 11, wire 12, and support 14. Support 14 supports the weight of intumescent disc 13 that is placed on the top of support 14. Support 14 and intumescent disc 13 can be attached to each other with a fastener or a rivet. Bracket 11 is attached to a plurality of wires 12 through connectors 19. The wires pass through tracks 32 (FIG. 6) on the intumescent disc and then through opening 31 (FIG. 8) on support 14. The wires 12 are held in place by stopper 15. Sub-assembly 17 is attached to housing 1. The attachment can be done by fastening bracket 11 to the top of the housing 1. A complementary screw hole 18 aligns with a hole on housing 1 and is fastened with butterfly nut 4 and washer 5. In another embodiment, the bracket 11 is riveted to the top of the housing 1.

FIGS. 2A and 2B are a side perspective view of the recessed lighting assembly. As illustrated, a light has not been placed inside housing 1. Bracket 11 has been attached to the top of the housing 1. Wires 12 are supported by the bracket 11. The intumescent disc 13 is resting on support 14. The support trim 10 has been placed inside of the housing 1 through placing screw 24 of housing 1 inside of groove 20 of support trim 10. The cut portion 23 of support trim 10 accommodates slot 2 and a screw 22 or other fastening means that attaches housing 1 to frame 8. Also shown in FIG. 2A is junction box 21 which is attached to frame 8. Also illustrated are hangers 9 for attaching the recessed lighting assembly to a joist.

The close up in FIG. 2B shows intumescent ring 7 placed inside cover 6. On the outside of the intumescent ring 7 cover 6 is placed. The intumescent ring 7 circles housing 1 on the outside of housing 1 in close proximity to the bottom opening of housing 1. Intumescent ring 7 has a plurality of channels 30 which can U shaped. These U-shaped channels 30 fit over slots 2 of housing a, and allow for fastening a fastener at any location in slots 2 without moving intumescent ring 7. After a manufacturer installs intumescent ring 7, there is no need to move intumescent ring 7 when an adjustment needs to be made when fastening housing 1 through slots 2. The role of the intumescent ring 7 is to close lateral openings of the housing, such as slot 2, in the event of a fire.

Figure 3:
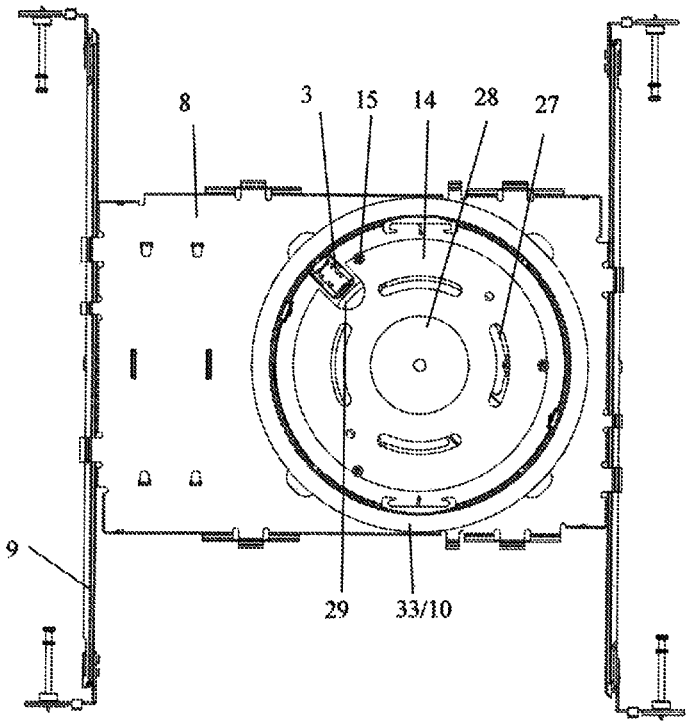
FIG. 3 is a bottom view of the fire rated recessed lighting assembly.

FIG. 3 is a bottom of the lighting assembly (without a light). The lighting assembly is shown with housing 1 attached to frame 8, which has hanger bars 9. Flange 33 of support trim 10 is visible in this view. Also shown is support 14 on top of which intumescent disc 13 rests. Support 14 has a central opening 29. Intumescent disc 13 has the same complementary central opening 29. Electric cable 3 enters housing 1 from side of the housing and in proximity to the top end of the housing 1. Support 14 and intumescent disc 13 have indentation 29 to accommodate the electric cable 3 entering housing 1. Also shown is stopper 15 keeping support 14 in place and not allowing it to fall out due to gravity. Support 14 is illustrated with heat vent 27.

Figure 4:
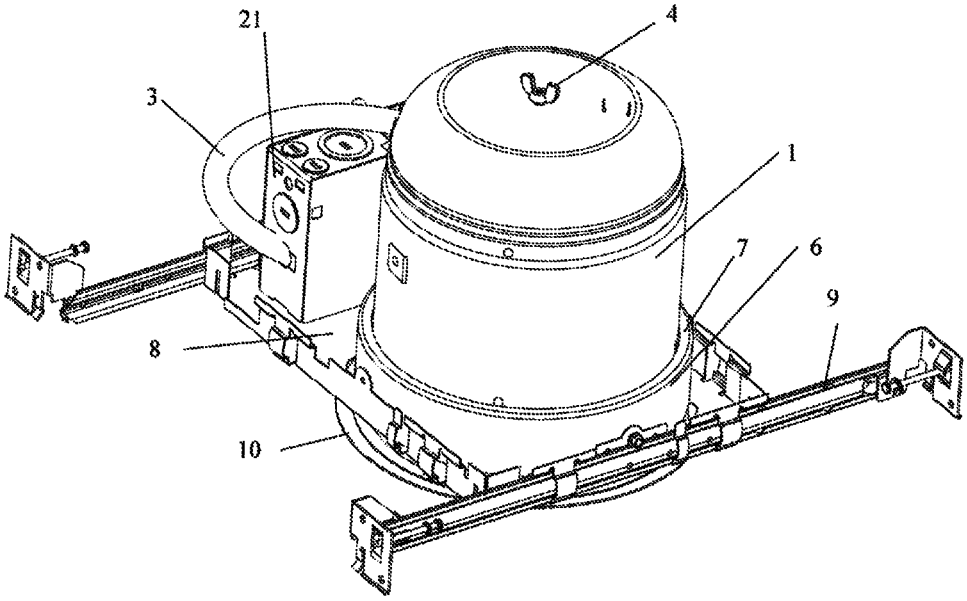
FIG. 4 is a top perspective view of the fire rated recessed lighting assembly.

FIG. 4 illustrates a top perspective view of the recessed lighting assembly. Illustrated are housing 1, which is attached to frame 8. Hangers 9 are also attached to frame 8. An electric cable 3 runs from junction box 21 to housing 1. Intumescent ring 7 circles housing 1 on the outside where slot 2 is present. Cover 6 surrounds and covers intumescent ring 7. Cover 6 also has the overall shape of a ring. Illustrated on the top of the housing is butterfly nut 4 for attaching bracket 11 to top of housing 1. Instead of butterfly nut 4, another type of nut, other fastening means, or a rivet can be used.

FIGS. 5A and 5B illustrate a cutaway view of inside of housing 1. These figures also show a socket 26 and decorative trim 16 placed inside of housing 1. When a person views the light assembly, the person generally sees decorative trim 16 placed inside of housing 1 surrounding a light source. The light source that is attached to the socket can be any typical light source, such as LED (light Emitting Diode), incandescent, or fluorescent. In case of an LED light, flat LED strips can be attached to surface of socket 26. For incandescent or fluorescent light source, socket 26 can be a traditional socket with threading for receiving a lamp. An LED lamp with threading can also be used. Intumescent ring 13 and support 14 rest on the back side of decorative trim 16. Socket 26 passes through the central opening 28 from one side of the intumescent disc 13/support 14 to the other side. When an electric cable enters housing 1, the electric cable is placed in the space formed between top end of housing 1 and intumescent disc 13. The electric cable 3 is connected to socket 26 in this space.

In the event of a fire, the decorative trim 16 and other parts of the lighting unit, which are made of aluminum, melt. Intumescent ring 13 also expands. The melting of decorative trim 16 and expansion of intumescent 13 causes a downward force on support 14. Support 14 slides down through wires 12 until the point in which it is stopped by stoppers 15, obtaining the position shown in FIG. 2. The downward movement of support 14 protects housing 1 from damage and removes any fire inside housing 1. Additionally, any fire has no chance of spreading upwards because the intumescent disc 13 protects the top of housing 1. When intumescent disc 13 expands, it will no longer have central opening 28 and will occupy the substantial volume of housing 1. Intumescent disc 13 is designed to substantially fill the entire space of housing 1. Similarly, intumescent ring 7 expands in a fire. The intumescent ring 7 covers slot 2 and any other side opening present in housing 1. Cover 6 is made of aluminum and is designed to crumple when intumescent ring 7 expands in a fire.

In an embodiment, housing 1, wire 12, stopper 15, support 14, nut 4 (or rivets), bracket 11, steel trim 10, frame 8, connector 19, and all fasteners/rivets are made of steel or other material that is designed not to melt in the event of a fire. The fasteners can further be zinc plated to impart a shin look to the fasteners.

Figure 6:
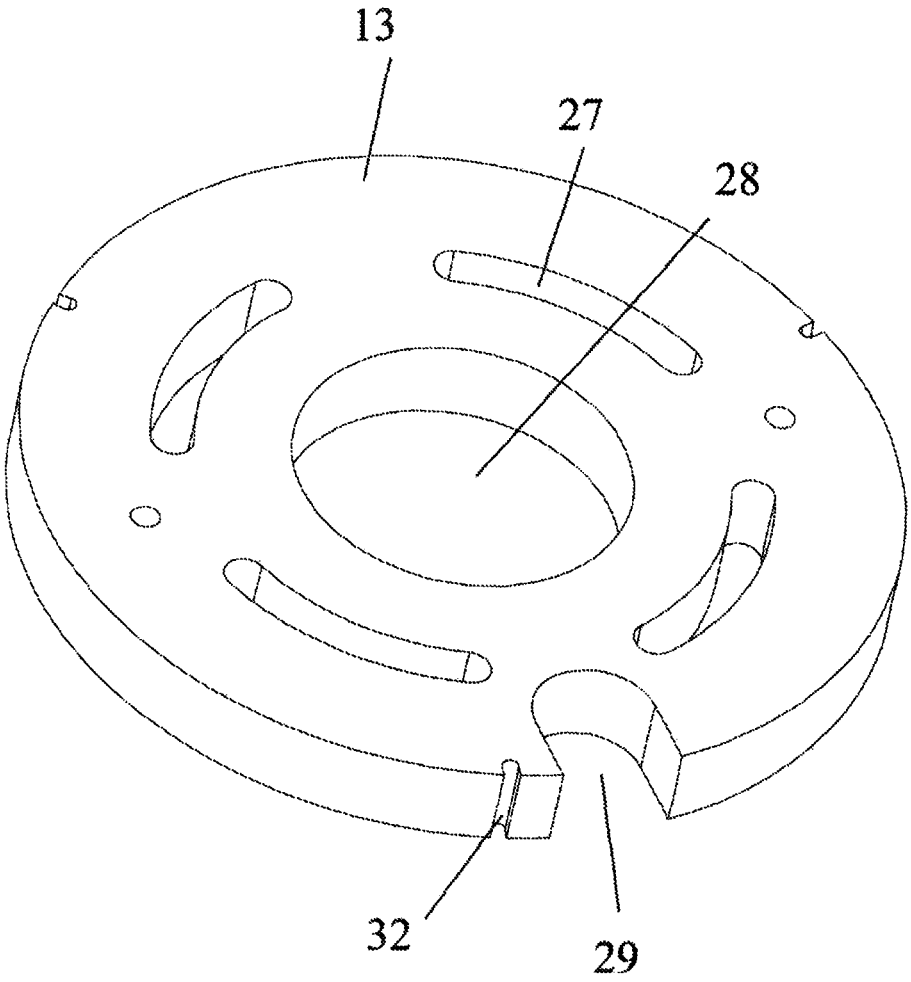
FIG. 6 is a top perspective view of an intumescent disc.

FIG. 6 is a perspective view of intumescent ring 13. Heat vents 27 allow for movement of air during ordinary use. Central opening 28 allows for placement of socket 26. Indentation 29 accommodates electric cable 3 at the point of entrance to housing 1. Tracks 32 allow for sliding against wires 12.

Figure 7:
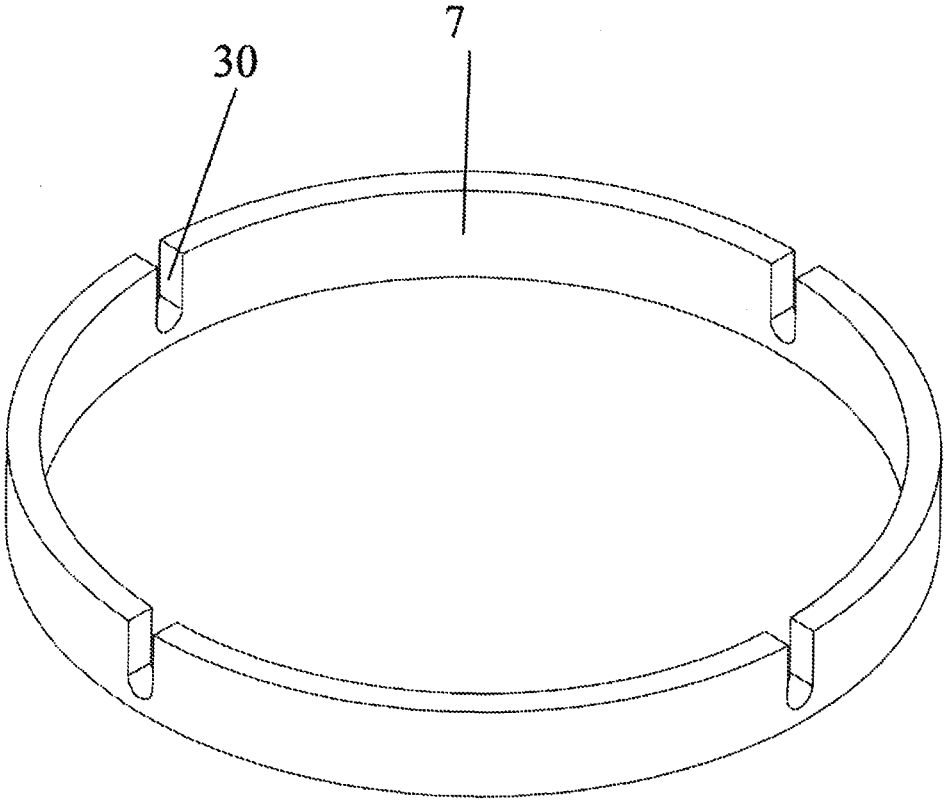
FIG. 7 is a top perspective view of an intumescent ring.

FIG. 7 is a top perspective view of intumescent ring 7. Intumescent ring 7 has a diameter that complements the diameter of housing 1. Intumescent ring 7 also has indentation that allow for placing the ring around screws or other fastening means. Intumescent ring 7 covers the lateral openings (slots 2) of housing 1 intended to attach housing 1 to frame 8.

Figure 8:
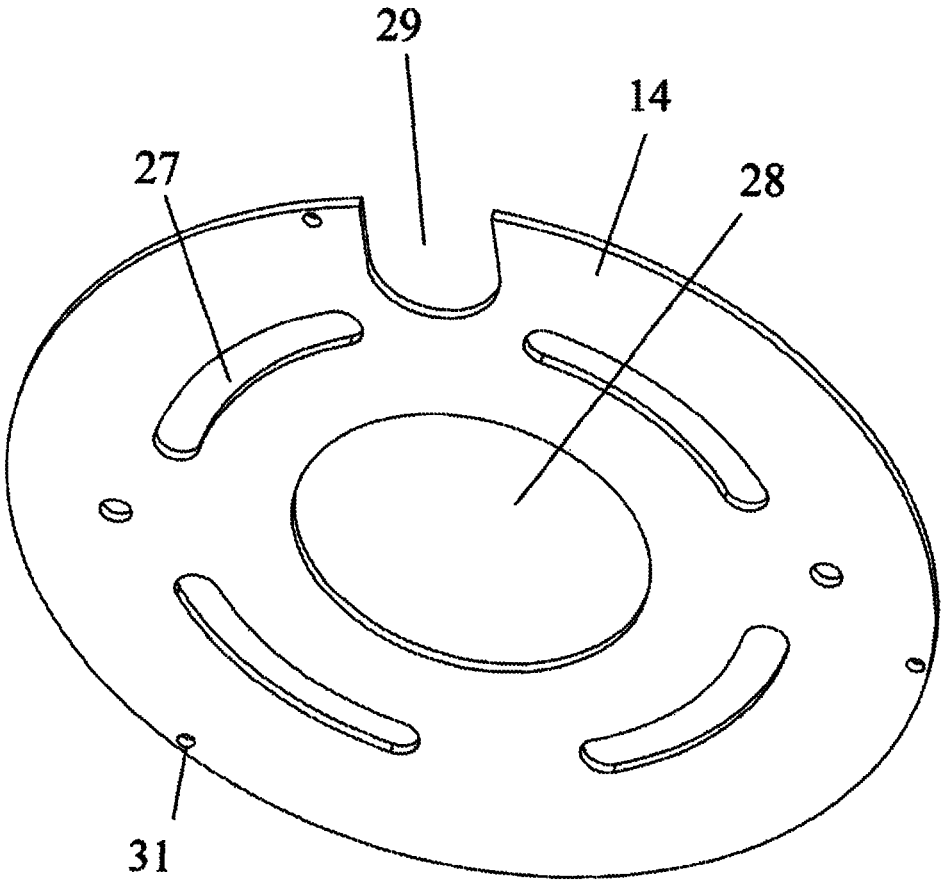
FIG. 8 is a top perspective view of an thin steel support in the shape of a disc.

FIG. 8 is a perspective view of support 14, which is typically made of a thin sheet of steel. Heat vents 27 allow for movement of air during ordinary use (non-fire event). Central opening 28 allows for placement of socket 26. Indentation 29 accommodates electric cable 3 at the point of entrance to housing 1. Openings 3 allow for sliding against wires 12. Opening 31 is designed so that it be smaller than stopper 15, and keep support 14 in place when wires 12 are fully extended.

Figure 9A:
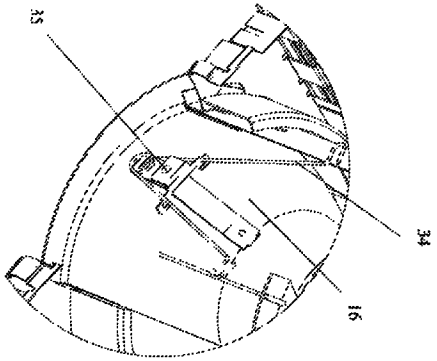
FIG. 9A is a close-up of FIG. 9B illustrating how a lighting unit is secured.
Figure 9B:
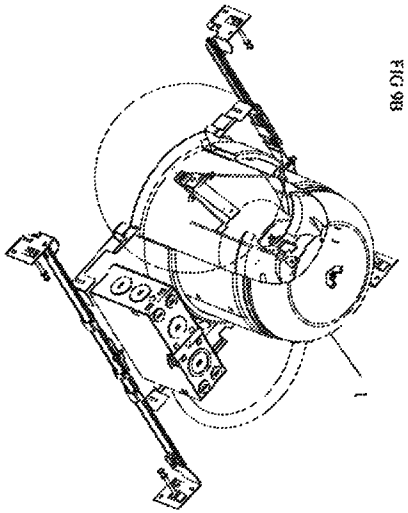
FIG. 9B illustrates how a lighting unit is secured.

FIGS. 9A and 9B illustrate how decorative trim 16 is kept in place. As illustrated, in this embodiment, the lighting unit has clips 34 that are held in place by a clip holder 35 that is attached to inside of housing 1. The clips 34 exhibit spring-like elastic movement, and press against clip holder 35.

The lighting assembly of the present invention can be manufactured in different sizes, including sizes that allow for 4 inch, 5 inch, and 6 inch aperture (which correspond approximately to the diameter of the opening of the can).

Support Disc 14 can have a thickness of about 1 mm to about 3 mm such as about 1.6 mm thickness. Support Disc 14 can have a diameter of about 110 mm to about 150 mm, such as about 132 mm. Intumescent disc 13 can have a thickness of about 10 to about 15 mm, such as about 12.8 mm. Intumescent disc 13 can have a diameter of about 110 mm to about 150 mm, such as about 132 mm. Intumescent disc 13 can have a central opening of about 40 mm to about 60 mm, such as about 51 mm. Intumescent ring 7 can have a diameter of about 150 mm to about 200 mm, such as about 171.5 mm (when measures from outside—Inside diameter is 159.5 mm), thickness of about 4 mm to about 8 mm such as about 6 mm, length of about 15 mm to about 25 mm, such as about 19 mm, and U channel length of about 10 mm to about 15 mm, such as about 12 mm.

Testing of the lighting assembly for fire rating can be conducted in accordance with the applicable requirements of, and following the standard methods of, ASTM E119-12a (version 14) Standard Test Methods for Fire Tests of Building Construction and Materials. For example, a 6 inch aperture lighting assembly can be tested as is that shown in FIG. 1. The lighting assembly can be installed in a large scale horizontal furnace in a UL L505 ceiling/floor type construction assembly and tested to the standard time-temperature curve described in the E119 standard. A lighting assembly as illustrated in FIG. 1 can be fire rated according to these standards.

According to WO2004039916, incorporated herein by reference, conventional fire resistant materials may be divided into different categories including: Halogen based: which consist of either brominated or chlorinated chemicals such as brominated polystyrene or phenylene oxide (Dead Sea Bromine or Great. Lakes CC) or his (hexachlorocyclopentadieno) cyclooetane (Occidental Cc). Phosphorus based: which consist of a range of different chemistries from elemental phosphorus (Clarient), phosphonates (A&W anti-blaze 1045), phosphonate esters (Akzo Nobel), phosphites, phosphates and polyphosphates including melamine phosphite and phosphate, ammonium and melamine polyphosphate (DSM Melapur). Nitrogen based: such as melamine and its salts (U.S. Pat. No. 4,511,684 Schmidt & Hoppe). Intumescent agents: incorporating (i) an acid source (carbonization catalyst) such as ammonium polyphosphate; (ii) a carbonization reagent e.g. polyhydric alcohols such as pentaerythritol; and (iii) a blowing reagent like melamine. Expandable graphite is also known to undergo thermal expansion on addition of heat. Inorganic additives: such as magnesium hydroxide and aluminum hydroxide (Martinswerk), zinc borate (Fire Brake ZB, US Borax) and antimony trioxide.

Examples of intumescent materials are provided for example in U.S. Pat. No. 7,320,536, which is incorporated herein by reference.

REFERENCES

1. Housing
2. Slot
3. Electric cable
4. Butterfly nut
5. Washer
6. cover
7. intumescent ring
8. frame
9. hangers
10. support trim
11. bracket
12. wire
13. intumescent disc.
14. support
15. stopper
16. decorative trim
17. sub-assembly
18. bracket opening
19. connector
20. trim groove
21. junction box
22. Slider screw
23. Cut Portion
24. Groove screw
25. Bracket screw
26. Socket

27. Heat Vent
28. Central opening
29. Indentation for electric cable
30. Channel
31. Opening
32. Tracks
33. Flange of trim
34. Clips
35. Clip Holder
36. Tab
37. Slots for tabs

What is claimed is:

1. A recessed lighting assembly comprising:

a) a metal housing inside of which a source of light is placed, the metal housing having an open and a closed end;

b) a member comprised of a flange portion and a tubular portion, the tubular portion configured to be attached to the metal housing at the open end, the flange portion extending radially and outwardly from the open end of the housing, the member configured to contact a ceiling in which the recessed lighting assembly is installed;

c) a trim placed inside of the housing in between the open end and the close end of the housing;

d) a socket, electronically connected to an electric cable, placed inside of the housing configured to receive a source of light; and e) a metal disc placed inside of the housing in between the trim and the closed end of the housing, the metal disc having a central opening configured for passage of the socket or the electric cable;

wherein the metal disc is configured to support a disc made from a fire resistant material placed on top of the metal disc in between the metal disc and the closed end of the housing, the fire resistant material selected from the group consisting of one or more of halogen based, phosphorous based, graphite, and intumescent.

2. The recessed lighting assembly claim 1, wherein the tubular part of the member is complementary to an inside of the open end of the housing, and is placed inside of the housing.

3. The recessed lighting assembly of claim 1, wherein the housing has one or more fasteners that cross a wall of the housing in proximity to the open end, the member configured to be detachably attached to the fastener.

4. The recessed lighting assembly of claim 1, wherein the housing has one or more slots configured to allow the housing to slide against a frame.

5. The recessed lighting assembly of claim 1, wherein the member has a cut portion on the tubular portion that is complementary to the slot.

6. The recessed lighting assembly of claim 1, further comprising one or more bar hangers attached to the frame configured to allow attachment of the recessed lighting assembly to one or more joists.

7. The recessed lighting assembly of claim 1, wherein the open end of the housing and one or more side openings of the housing are sealed in an event of a fire.

8. The recessed lighting assembly of claim 1, wherein the metal disc has a diameter of 110 mm to 150 mm.

9. The recessed lighting assembly of claim 1, wherein the metal disc has a thickness of 1 mm to 3 mm.

10. The recessed lighting assembly of claim 1, wherein the tubular portion has a height of 3 cm to 5 m.

11. The recessed lighting assembly of claim 1, wherein the flange has a length of 1 cm to 1.5 cm.

12. A recessed lighting assembly comprising:

a) a metal housing inside of which a source of light is placed, the metal housing having an open and a closed end, the metal housing having one or more slots in proximity to the open end;

b) a frame adjustably attached to the metal housing, through the slots;

c) a member comprised of a flange portion and a tubular portion, the tubular portion configured to be attached to the metal housing at the open end, the flange portion extending radially and outwardly from the open end of the housing, the member having cut portions in the tubular portions that complement the slots on the housing;

d) a trim placed inside of the housing in between the open end and the close end of the housing, e) a socket, electronically connected to an electric cable, placed inside of the housing configured to receive a source of light;

f) a metal disc placed inside of the housing in between the trim and the closed end of the housing, the metal disc having a central opening configured for passage of the socket or the electric cable; and g) one or more bar hangers attached to the frame configured to allow attachment of the recessed lighting assembly to a support structure;

wherein the metal disc is configured to support a disc made from a fire resistant material placed on top of the metal disc in between the metal disc and the closed end of the housing, the fire resistant material selected from the group consisting of one or more of halogen based, phosphorous based, graphite, and intumescent.

* * * * *